US009020390B2

(12) United States Patent
Fukamachi et al.

(10) Patent No.: US 9,020,390 B2
(45) Date of Patent: Apr. 28, 2015

(54) DEVELOPING DEVICE HAVING SEAL MEMBERS TO RESTRICT TONER LEAKAGE

(71) Applicants: Yasuo Fukamachi, Nagoya (JP); Masahiro Ishii, Nagoya (JP); Keigo Nakajima, Nagoya (JP); Takuya Kanda, Nagoya (JP); Kenta Tosuji, Nagoya (JP)

(72) Inventors: Yasuo Fukamachi, Nagoya (JP); Masahiro Ishii, Nagoya (JP); Keigo Nakajima, Nagoya (JP); Takuya Kanda, Nagoya (JP); Kenta Tosuji, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/849,669

(22) Filed: Mar. 25, 2013

(65) Prior Publication Data

US 2013/0287431 A1 Oct. 31, 2013

(30) Foreign Application Priority Data

Apr. 27, 2012 (JP) ..... 2012-103938

(51) Int. Cl.
*G03G 15/08* (2006.01)

(52) U.S. Cl.
CPC ..... *G03G 15/0898* (2013.01); *G03G 15/0817* (2013.01)

(58) Field of Classification Search
CPC ..... G03G 15/0898; G03G 15/0817
USPC ..... 399/103, 105
See application file for complete search history.

(56) References Cited

U.S. PATENT DOCUMENTS

| | | | | |
|---|---|---|---|---|
| 5,488,462 | A | 1/1996 | Ishikawa et al. | |
| 5,502,547 | A | 3/1996 | Shirai | |
| 6,070,027 | A * | 5/2000 | Kawai et al. | 399/103 |
| 6,336,014 | B1 | 1/2002 | Sato et al. | |
| 6,496,668 | B2 | 12/2002 | Sato et al. | |
| 7,680,430 | B2 | 3/2010 | Mori et al. | |
| 7,706,715 | B2 | 4/2010 | Mori et al. | |
| 7,899,356 | B2 | 3/2011 | Mori et al. | |

(Continued)

FOREIGN PATENT DOCUMENTS

| | | | |
|---|---|---|---|
| EP | 2 175 325 | A2 | 4/2010 |
| JP | 2001005287 | A | 1/2001 |

(Continued)

OTHER PUBLICATIONS

Aug. 14, 2014—(US) Non-Final Office Action—U.S. Appl. No. 13/849,582.

(Continued)

*Primary Examiner* — Sophia S Chen
(74) *Attorney, Agent, or Firm* — Banner & Witcoff, Ltd.

(57) ABSTRACT

A developing device includes: a frame having an opening; a developer carrying member rotatably supported to the frame; and a side seal. The developer carrying member is rotatable about its axis in a rotating direction and has an axial end portion in an axial direction. The side seal is disposed between the frame and a peripheral surface of the axial end portion, and has a contact member contacting the peripheral surface. The contact member includes: a first seal member disposed adjacent to an edge of the opening in the axial direction; and a second seal member disposed adjacent to and upstream of the first seal member in the rotating direction. The first seal member permits developer to move inward in the axial direction and provides a mobility of developer therein higher than that of the second seal member that is made of a material that restricts movement of developer.

12 Claims, 9 Drawing Sheets

(56) References Cited

U.S. PATENT DOCUMENTS

| | | | | |
|---|---|---|---|---|
| 8,086,134 | B2 * | 12/2011 | Xu et al. | 399/103 |
| 8,107,850 | B2 | 1/2012 | Xu et al. | |
| 8,229,317 | B2 | 7/2012 | Xu et al. | |
| 8,301,056 | B2 | 10/2012 | Matsushita et al. | |
| 8,478,158 | B2 | 7/2013 | Matsushita et al. | |
| 8,521,057 | B2 | 8/2013 | Matsushita et al. | |
| 2002/0141777 | A1 | 10/2002 | Kamimura et al. | |
| 2005/0158070 | A1 | 7/2005 | Ishii | |
| 2006/0024085 | A1 | 2/2006 | Sato et al. | |
| 2007/0140729 | A1 | 6/2007 | Carter et al. | |
| 2009/0274482 | A1 | 11/2009 | Xu et al. | |
| 2010/0092206 | A1 | 4/2010 | Matsushita et al. | |
| 2011/0236057 | A1 * | 9/2011 | Nakajima et al. | 399/103 |
| 2012/0269538 | A1 | 10/2012 | Matsushita et al. | |
| 2012/0269539 | A1 | 10/2012 | Matsushita et al. | |
| 2013/0287430 | A1 | 10/2013 | Fukamachi et al. | |

FOREIGN PATENT DOCUMENTS

| | | | |
|---|---|---|---|
| JP | 2006-039428 | A | 2/2006 |
| JP | 2010-091951 | A | 4/2010 |
| WO | WO 2011/127834 | A1 * | 10/2011 |

OTHER PUBLICATIONS

Nov. 13, 2014—(EP) Extended Search Report—App 13160556.0.

Nov. 13, 2014—(EP) Extended Search Report—App 13160550.3.

* cited by examiner

DEVELOPING DEVICE HAVING SEAL MEMBERS TO RESTRICT TONER LEAKAGE

CROSS REFERENCE TO RELATED APPLICATION

This application claims priority from Japanese Patent Application No. 2012-103938 filed Apr. 27, 2012. The entire content of the priority application is incorporated herein by reference.

TECHNICAL FIELD

The present invention relates to a developing device that is mountable in an image-forming apparatus, such as a color printer.

BACKGROUND

Electrophotographic printers with detachably mountable developing cartridges are well known in the art. The developing cartridge is provided with an outer case rotatably supporting a developing roller that serves to carry toner on the surface thereof; a thickness-regulating blade regulating a thickness of a layer of toner carried on the developing roller; and side seals designed to prevent toner from leaking out of axial ends of the outer case with respect to an axial direction of the developing roller.

As one of such conventional developing cartridge, there is proposed a developer cartridge whose thickness-regulating blade is configured of a leaf spring member, and a rubber pressing member disposed on the leaf spring member for contacting a peripheral surface of a developing roller with pressure. Each side seal includes a sponge seal member affixed to an outer case, and a felt seal member layered over the sponge seal member. The felt seal members contact the peripheral surface of the developing roller and slide over the peripheral surface as the developing roller rotates.

With this conventional developer cartridge, an upper end of each sponge seal member is interposed between a lower end of the leaf spring member and the outer case. The felt seal member extends from the lower end of the leaf spring member across the sponge seal member to a bottom end of the outer case and is affixed thereto.

SUMMARY

However, with the recent trends to increase the rotational speed of the developing roller in order to improve image formation speeds, to extend service life of the developer cartridge, and to reduce toner particle sizes for low-temperature fixing, the conventional developer cartridge described above may be unable to restrict toner leakage from the outer case sufficiently.

Therefore, it is an object of the present invention to provide a developing device capable of suppressing toner leakage from its outer case.

In order to attain the above and other objects, there is provided a developing device including: a frame; a developer carrying member rotatably supported to the frame; and a side seal. The frame is formed with an opening and having an internal space for accommodating developer therein. The developer carrying member is disposed to oppose the internal space via the opening, the developer carrying member defining an axis extending in an axial direction and configured to rotate about the axis in a rotating direction, the developer carrying member having an axial end portion and a remaining portion inward of the axial end portion in the axial direction. The side seal is disposed between the frame and a peripheral surface of the axial end portion of the developer carrying member and includes a contact member configured to be in contact with the peripheral surface of the axial end portion. The contact member includes a first seal member and a second seal member. The first seal member is disposed adjacent to an edge of the opening in the axial direction and configured to permit the developer entering the first seal member by rotation of the developer carrying member to move inward in the axial direction. The second seal member is disposed adjacent to and upstream of the first seal member in the rotational direction and is a separate member from the first seal member. The second seal member is made of a material that restricts movement of the developer entering therein by the rotation of the developing roller, the first seal member providing a mobility of the developer therein higher than that in the second seal member.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

1. Overall Structure of a Printer

A printer 1 according to a first embodiment of the present invention will be described while referring to FIGS. 1 through 8.

Figure 1:
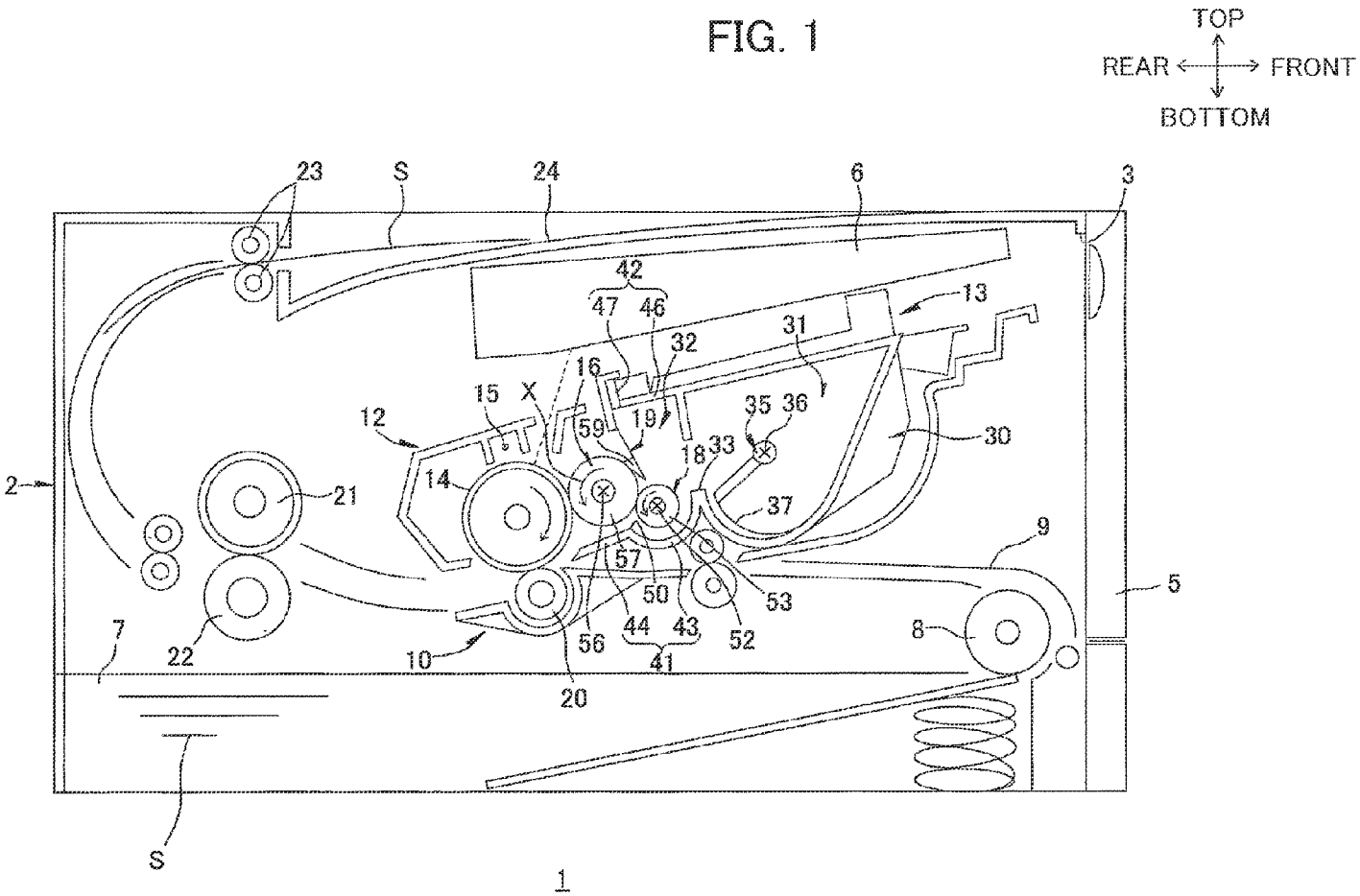
FIG. 1 is a central cross-sectional view of a printer accommodating a developing device according to a first embodiment of the present invention.

As shown in FIG. 1, the printer 1 includes a main casing 2 that is substantially box-shaped. A front cover 5 is provided on one side wall of the main casing 2. The front cover 5 can be pivoted open and closed about its bottom end portion to expose and cover an access opening 3.

In the following description, the side of the main casing 2 on which the front cover 5 is provided (the right side in FIG. 1) will be called the "front side," and the opposite side (the left side in FIG. 1) will be called the "rear side." Further, the left and right sides of the main casing 2 will be defined assuming that the printer 1 is viewed from its front side. In addition, front, rear, left, right, top, and bottom sides of a developing cartridge 13 (described later) will be defined based on a mounted state of the developing cartridge 13 relative to the main casing 2.

The printer 1 is provided with a process cartridge 10. The process cartridge 10 includes a drum cartridge 12 that is detachable mounted in the main casing 2, and the developing cartridge 13 that detachable mounted on the drum cartridge 12.

The drum cartridge 12 includes a photosensitive drum 14 and a scorotron charger 15.

The photosensitive drum 14 is rotatably supported to a rear end portion of the drum cartridge 12 and is exposed through a lower front side of the same. The scorotron charger 15 is disposed above the photosensitive drum 14, confronting a surface of the photosensitive drum 14 with a gap formed therebetween.

The developing cartridge 13 includes a developing frame 30 and a developing roller 16. The developing roller 16 is rotatably supported to a rear end portion of the developing frame 30 and is exposed through the rear side thereof. The developing roller 16 contacts the front side of the photosensitive drum 14 when the developing cartridge 13 is mounted on the drum cartridge 12. The developing cartridge 13 is also provided with a supply roller 18 for supplying toner onto the developing roller 16, and a thickness-regulating blade 19 for regulating a thickness of toner carried on the developing roller 16. The developing cartridge 13 accommodates toner in a portion positioned frontward of the supply roller 18.

Toner in the developing cartridge 13 is supplied onto the supply roller 18, which in turn supplies the toner to the developing roller 16. During this process, the toner is positively tribocharged between the supply roller 18 and developing roller 16. The thickness-regulating blade 19 regulates the toner carried on the developing roller 16 so as to maintain the layer of toner on a surface of the developing roller 16 at a thin uniform thickness.

In the meantime, the scorotron charger 15 applies a uniform charge to the surface of the photosensitive drum 14 as the photosensitive drum 14 rotates. Next, a scanner unit 6 provided in a top section of the main casing 2 selectively irradiates a laser beam (indicated by a dashed line in FIG. 1) onto the surface of the positively charged photosensitive drum 14, forming an electrostatic latent image on the surface based on image data. Next, the positively charged toner carried on the surface of the developing roller 16 is supplied to the latent image formed on the surface of the photosensitive drum 14, developing the latent image into a toner image.

A paper tray 7 is detachably mounted in a bottom section of the main casing 2 for accommodating sheets S. A pick-up roller 8 picks up the sheets S in the paper tray 7 and conveys the sheets S one at a time along a U-shaped conveying path 9. The pick-up roller 8 feeds each sheet S at a prescribed timing between the photosensitive drum 14 and a transfer roller 20. The sheet S is conveyed rearward between the photosensitive drum 14 and transfer roller 20. At this time, the toner image carried on the photosensitive drum 14 is transferred onto the sheet S.

Subsequently, the sheet S passes between a heating roller 21 and a pressure roller 22, at which time the toner image is fixed to the sheet S by heat and pressure. Next, the sheet S is conveyed toward discharge rollers 23. The discharge rollers 23 discharge the sheet S onto a discharge tray 24 formed on a top surface of the main casing 2.

2. Detailed Description of the Developer Cartridge

Figure 2:
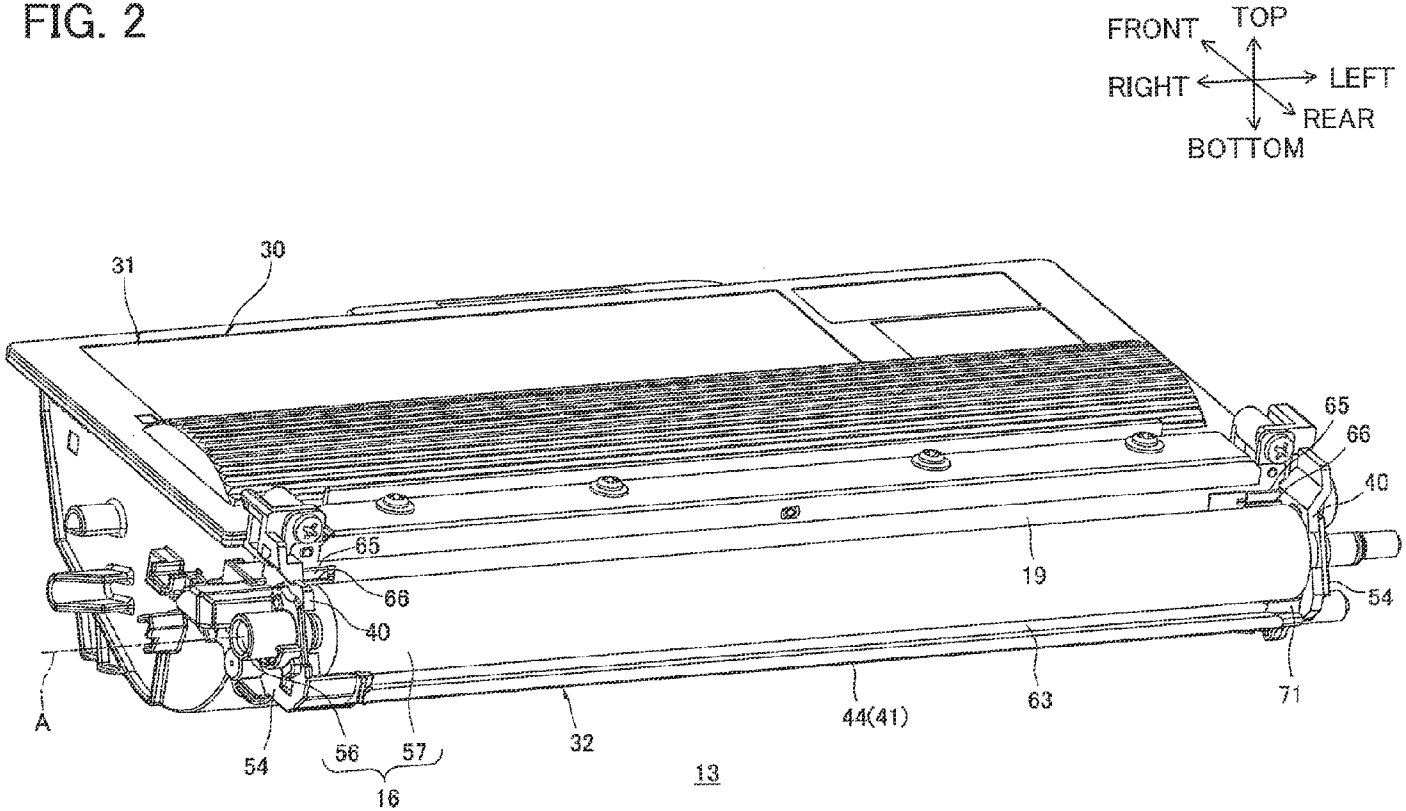
FIG. 2 is a perspective view of the developing device of FIG. 1 as viewed from its rear and right side, the developing device having a developing frame and a developing roller.

As shown in FIG. 2, the developing cartridge 13 includes the developing frame 30. The developing frame 30 has a generally box shape and is elongated in a left-right direction. As shown in FIG. 1, the developing frame 30 includes a toner-accommodating chamber 31 constituting the front portion, and a developing chamber 32 constituting the rear portion.

(1) Toner-Accommodating Chamber

The toner-accommodating chamber 31 is generally box-shaped and elongated in the left-right direction. The toner-accommodating chamber 31 accommodates a positive-charging, nonmagnetic, single-component polymer toner. An agitator 35 is disposed in the toner-accommodating chamber 31 and is positioned in approximately a vertical and front-rear center thereof.

The agitator 35 includes an agitator shaft 36 oriented in the left-right direction, and an agitating blade 37 extending radially outward from the agitator shall 36. With left and right ends of the agitator shaft 36 supported in corresponding side walls of the developing frame 30, the agitator 35 is rotatably supported in the developing frame 30.

(2) Developing Chamber

Figure 4:
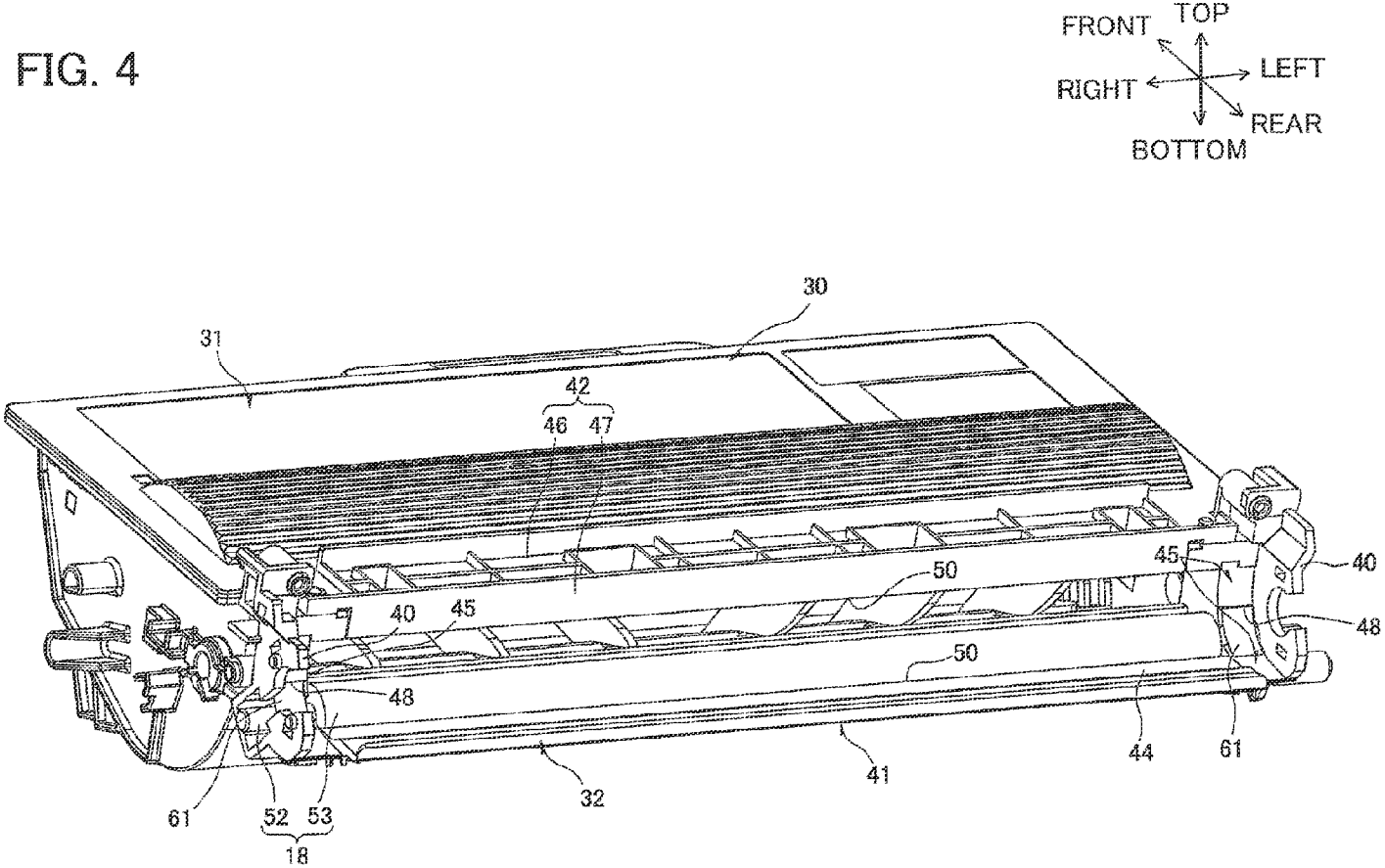
FIG. 4 is a perspective view of the developing frame of FIG. 2 as viewed from its rear and right side, wherein a supply roller and supply-side seal members are assembled to the developing frame.

The developing chamber 32 is formed continuously with a rear end of the toner-accommodating chamber 31, having a substantially rectangular cross section with an opening on the rear side. The toner accommodating chamber 31 and developing chamber 32 are in communication via a through-hole 33 that penetrates a partitioning wall in a front-rear direction. As shown in FIG. 4, the developing chamber 32 is configured of a pair of side walls 40 arranged parallel to each other and separated in the left-right direction, a bottom wall 41 bridging lower edges of the side walls 40, and a top wall 42 bridging upper and rear edges of the side walls 40.

The side walls 40 have a generally flat plate shape and extend rearward from rear edges of left and right side walls of the inner-accommodating chamber 31, respectively.

As shown in FIG. 1, the bottom wall 41 has a generally flat plate shape extending rearward from a rear edge of a bottom wall of the toner-accommodating chamber 31. The bottom wall 41 is integrally configured of an arc-shaped wall 43 constituting the front-portion, and a film-supporting wall 44 constituting the rear portion.

The arc-shaped wall 43 has a generally arcuate shape in a side view that follows a rotational path of the supply roller 18. The arc-shaped wall 43 has a front edge linked to the rear edge of the bottom wall of the toner-accommodating chamber 31.

The film-supporting wall 44 has a generally flat plate shape and extends rearward from a rear edge of the arc-shaped wall 43.

The top wall 42 has a generally flat plate shape. In a side view, the top wall 42 is L-shaped. Specifically, as shown in FIG. 4, the top wall 42 is integrally provided with an opposing wall 46 extending in the front-rear direction, and a blade-supporting wall 47 extending upward from a rear edge of the opposing wall 46.

As shown in FIG. 1, the opposing wall 46 has a general flat plate shape and extends rearward from a rear edge of a top wall of the toner-accommodating chamber 31. The opposing wall 46 opposes the arc-shaped wall 43 in a generally vertical direction, with a gap formed therebetween.

The blade-supporting wall 47 has a general flat plate shape and is formed continuously with a rear edge of the opposing wall 46, extending upward therefrom.

Seal support parts 45 are also integrally provided in the developing chamber 32. One of the seal support parts 45 is provided on each of left and right end portions within the developing chamber 32. Each seal support part 45 has a generally flat plate shape with a wide left-right dimension.

Figure 3A:
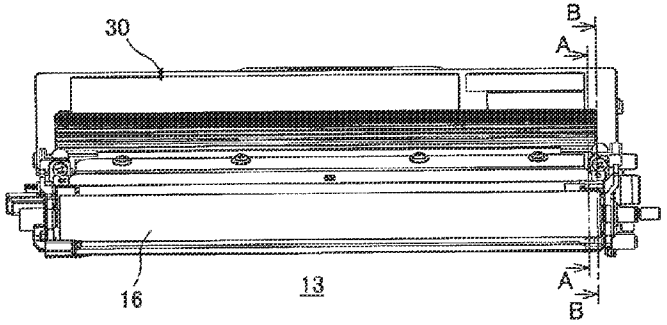
FIG. 3A is a rear side view of the developing device of FIG. 1.
Figure 3B:
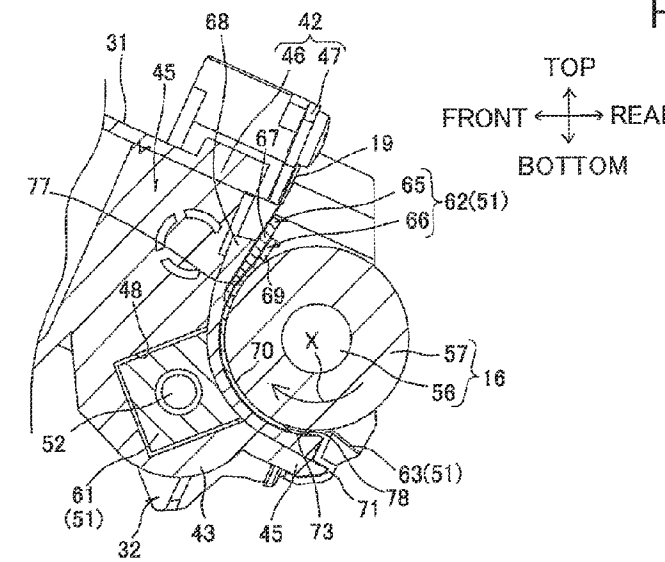
FIG. 3B is a partially-enlarged cross-sectional view of a rear portion of the developing device of FIG. 3A taken along a line A-A in FIG. 3A.

More specifically, as shown in FIG. 3B, the seal support part 45 has a front portion extending upward from a top surface of the arc-shaped wall 43, with an upper edge of the front portion connected to the opposing wall 46. The seal support part 45 has a rear portion that is generally rectangular in a side view and protrudes diagonally downward and rearward from a lower rear edge constituting the front portion of the seal support part 45. As shown in FIG. 4, the respective seal support parts 45 have outer left and right ends that are coupled with inner right and left surfaces of the corresponding side walls 40. Further, as shown in FIG. 3B, the seal support part 45 has a rear surface having a generally arcuate shape that follows the rotational path of the developing roller 16.

A supply-roller seal groove 48 is formed in each seal support part 45. The supply-roller seal groove 48 is formed in the rear surface of each seal support part 45 at a position corresponding to a left or right end of a supply roller shaft 52 (described later). The supply-roller seal grooves 48 are generally rectangular in a side view and are recessed into a lower portion of the seal support part 45 in a forward and slightly downward diagonal direction so as to be open on the rear side.

As shown in FIG. 4, an open area 50 is formed in the developing chamber 32, opening rearward. The open area 50 is defined by the rear edge of the arc-shaped wall 43 (see FIG. 1), inner left and right edges of the seal support parts 45, and the rear edge of the opposing wall 46 (sec FIG. 1).

As shown in FIG. 1, the developing chamber 32 includes the supply roller 18 developing roller 16, thickness-regulating blade 19, and a pair of seal members 51 (see FIG. 3B). As shown in FIG. 4, the supply roller 18 includes the supply roller shaft 52, and a sponge roller 53.

The supply roller shaft 52 is generally cylindrical in shape and is oriented in the left-right direction.

The sponge roller 53 covers the supply roller shaft 52 while leaving the left and right ends of the supply roller shaft 52 exposed. The sponge roller 53 has a left-right length that is slightly shorter than a left-right distance between the two seal support parts 45.

The supply roller 18 is disposed in the developing chamber 32 such that the peripheral surface of the sponge roller 53 confronts but is separated from the inner surface of the arc-shaped wall 43 (see FIG. 1), and the left and right ends of the simply roller shaft 52 are positioned within the supply-roller seal grooves 48 of the corresponding seal support parts 45 (see FIG. 3B). The left and right ends of the supply roller shaft 52 are rotatably supported to the side walls 40 through bearing members 54 (see FIG. 2). With this configuration, the supply roller 18 is rotatably provided in the developing frame 30.

During a developing operation, a drive force is transmitted to the supply roller 18 from a drive source (not shown), such as a motor, provided in the main casing 2. A power supply (not shown) also applies a supply bias to the supply roller 18 during the developing operation. When the drive force is transmitted from the drive source, the supply roller 18 is driven to rotate in a direction indicated by an arrow in FIG. 1 (counterclockwise in a left side view) so that a portion of the supply roller 18 confronting and contacting the developing roller 16 moves in a direction opposite from a contacted portion of the developing roller 16.

As shown in FIG. 2, the developing roller 16 is configured of a developing roller shaft 56, and a rubber roller 57.

The developing roller shaft 56 is generally cylindrical in shape and oriented in the left-right direction.

The rubber roller 57 covers the developing roller shaft 56 while leaving left and right ends of the developing roller shaft 56 exposed. The rubber roller 57 has a left-right length that is substantially equivalent to (slightly shorter than) a distance formed between the pair of side walls 40.

As shown in FIG. 1, the developing roller 16 is disposed on the upper rear side of the supply roller 18 such that the rubber roller 57 contacts the upper rear side of the sponge roller 53 and the peripheral surface of the rubber roller 57 faces the interior of the developing chamber 32 through the open area 50. As shown in FIG. 2, the left and right ends of the developing roller shaft 56 are rotatably supported to the corresponding side walls 40 through the hearing members 54. With this configuration, the developing roller 16 is capable of rotating relative to the developing frame 30 about a central axis A (shown in FIG. 2).

During a developing operation, a drive force is transmitted to the developing roller 16 from a drive source (not shown), such as a motor, provided in the main casing 2. A power supply (not shown) also applies a developing bias to the developing roller 16 during the developing operation. When the drive force is transmitted from the drive source, the developing roller 16 is driven to rotate in a rotating direction X indicated by an arrow in FIG. 1 (counterclockwise in a left-side view) so that the portion of the developing roller 16 confronting and contacting the supply roller 18 moves in the opposite direction from the contacted potion of the supply roller 18.

Figure 6:
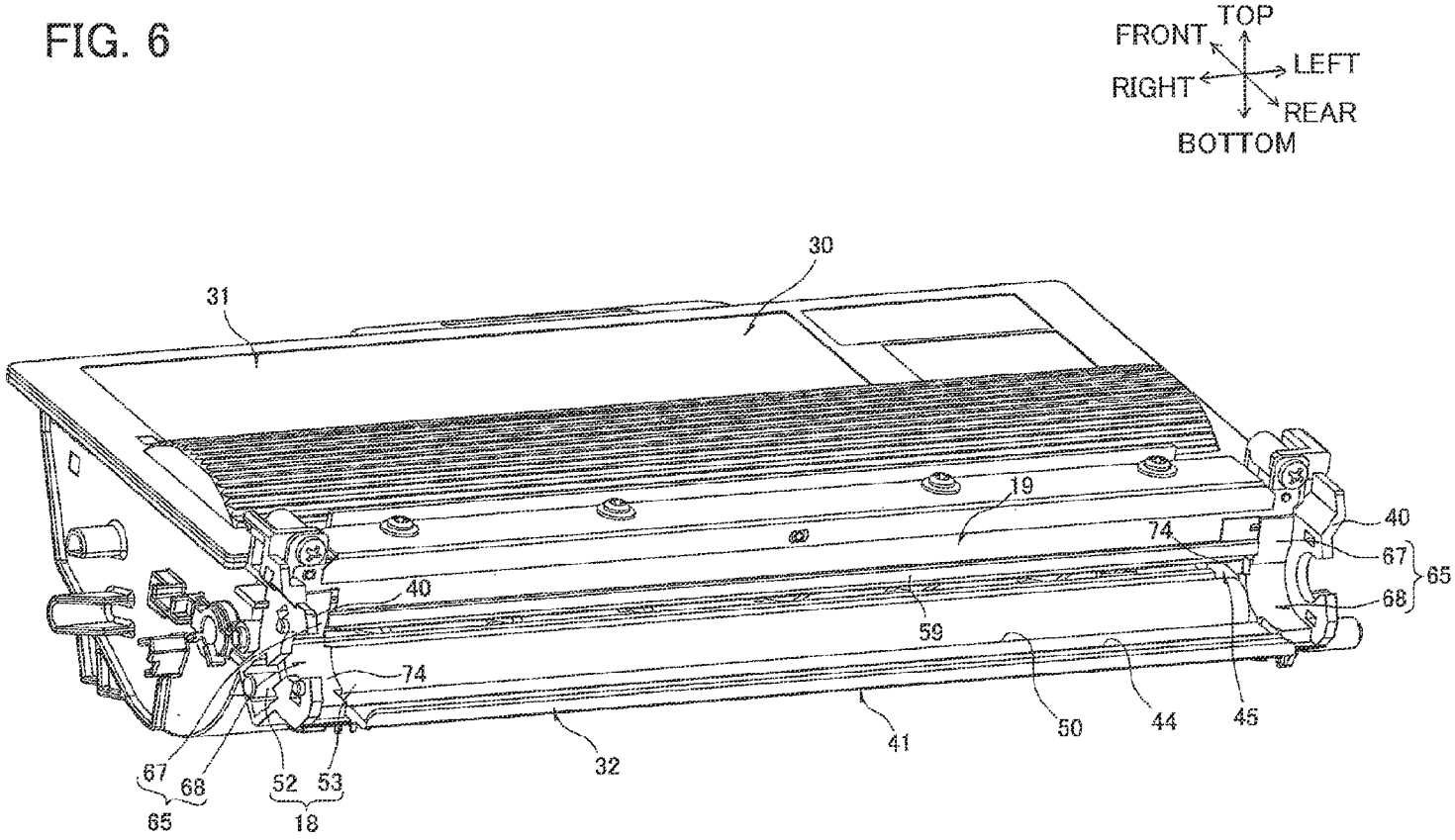
FIG. 6 is a perspective view of the developing device according to the first embodiment as viewed from its rear and right side, wherein a thickness-regulating blade and a blade-side base have been assembled to the developing frame of FIG. 5.

The thickness-regulating blade 19 is formed of a flexible thin metal plate or the like. As shown in FIG. 6, the thickness-regulating blade 19 has a generally flat plate shape that is elongated in the left-right direction.

A contact part 59 is provided on a bottom edge of the thickness-regulating blade 19, as shown in FIGS. 1 and 6. The contact part 59 is formed of an elastic resin material, such as silicone rubber. The contact part 59 is provided on a rear surface of the thickness-regulating blade 19 and spans a lower edge thereof in the left-right direction. As illustrated in FIG.

1, the contact part 59 is generally triangular in a side view and protrudes rearward from the rear surface of the thickness-regulating blade 19. The contact part 59 has a left-right length shorter than that of the thickness-regulating blade 19. The contact part 59 is positioned in approximately a left-right center region of the thickness-regulating blade 19 so that left and right ends of the contact part 59 are stepped inward with respect to the left-right direction from the corresponding left and right ends of the thickness-regulating blade 19.

As shown in FIG. 1, the thickness-regulating blade 19 is fixed to a rear surface of the blade-supporting wall 47 (see FIG. 4) so that the contact part 59 contacts the peripheral surface of the rubber roller 57 from front side thereof, with the contact part 59 spanning the left-right length of the rubber roller 57 (see FIG. 2).

As shown in FIG. 3B, each seal member 51 includes a supply-roller side seal 61, a developing-roller side seal 62, and a lower film 63.

As shown in FIG. 4, two supply-roller side seals 61 are provided to correspond to the left and right ends of the supply roller shaft 52. As shown in FIG. 3B, the supply-roller side seals 61 are generally rectangular in a side view. The left and right ends of the supply roller shaft 52 penetrate center portions of the corresponding supply-roller side seals 61 in the left-right direction. Hence, as shown in FIG. 4, the left and right supply-roller side seals 61 are disposed outward of the respective left and right ends of the sponge roller 53 and confront the left and right ends of the sponge roller 53 in the left-right direction. The supply-roller side seal 61 has a rear surface of a generally arcuate shape that follows the rotating path of the developing roller 16 and is formed flush with the rear surface of the seal support part 45. As shown in FIG. 3B, the supply-roller side seals 61 are accommodated in the corresponding supply-roller seal grooves 48.

The developing-roller side seal 62 is disposed between the rear surface of the seal support part 45 and the peripheral surface of the rubber roller 57 on the corresponding left or right end thereof. The developing-roller side seal 62 includes a support member 65 disposed on the seal support part 45 side, and a contact member 66 disposed on the rubber roller 57 side.

Figure 5:
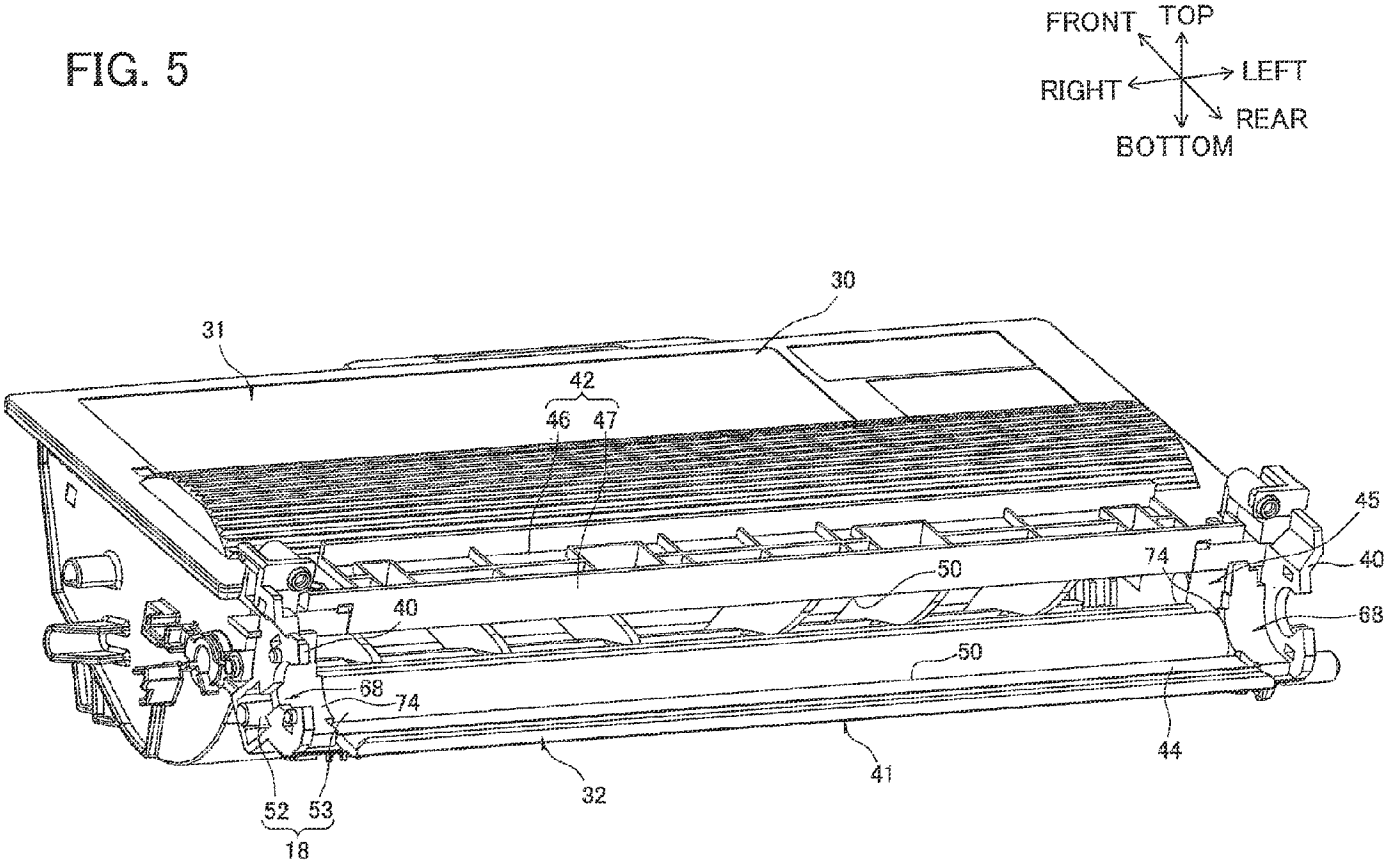
FIG. 5 is a perspective view of the developing device according to the first embodiment as viewed from its rear and right side, wherein frame-side bases have been assembled to the developing frame of FIG. 4.

The support member 65 is provided between the contact member 66 and the seal support part 45. As shown in FIGS. 5 and 6, the support member 65 is configured of a frame-side base 68 (see FIG. 5), and a blade-side base 67 (see FIG. 6).

As shown in FIG. 5, the frame-side base 68 is formed of an elastic foam material, such as a methane sponge member. The frame-side base 68 is generally rectangular in a rear view and is elongated vertically. The frame-side base 68 has a left-right dimension substantially equivalent to the left-right dimension of the seal support part 45.

A protruding part 74 is integrally provided on each frame-side base 68. The protruding parts 74 are formed on left and right inner surfaces of the corresponding frame-side bases 68 in substantially a vertical center region thereof. The protruding parts 74 are generally rectangular in a rear view and protrude inward in the left-right direction so as to oppose corresponding left and right endfaces of the sponge roller 53.

As shown in FIG. 3B, each frame-side base 68, from top to bottom (from its upstream side to its downstream side in the rotating direction X), is bonded to the rear surface of the corresponding seal support part 45. Hence, the frame-side base 68 is curved, forming a general C-shape in a side view, with the opening of the "C" facing rearward. As shown in FIG. 3B, the upper end of the frame-side base 68 is interposed between the rear surface of the seal support part 45 on the upper end thereof, and the front surface of the thickness-regulating blade 19 on the lower edge thereof.

The blade-side base 67 is formed of an elastic fears material, such as a urethane sponge member. As shown in FIG. 6, the blade-side base 67 is generally rectangular in a rear view and elongated vertically. The blade-side base 67 has a left-right dimension substantially equal to that of the frame-side base 68, while having a thickness (dimension in a direction that the support member 65 opposes the developing roller 16) smaller than the thickness of the frame-side base 68. The blade-side bases 67 are provided on the rear surface of the thickness-regulating blade 19 at respective left and right ends thereof. Thus, the blade-side bases 67 are spaced apart in the left-right direction, with the contact part 59 interposed therebetween. The blade-side bases 67 are bonded to the rear surface of the thickness-regulating blade 19 so that the bottom ends of the blade-side bases 67 protrude further downward man the lower edge of the thickness-regulating blade 19.

As shown in FIG. 3B, the contact member 66 is disposed between the corresponding support member 65 and the peripheral surface of the rubber roller 57. The contact member 66 has a rear surface that contacts the peripheral surface of the rubber roller 57 on the corresponding left or right end thereof. The contact member 66 has a left-right dimension substantially equivalent to that of the frame-side base 68, as illustrated in FIG. 7A.

Figure 7B:
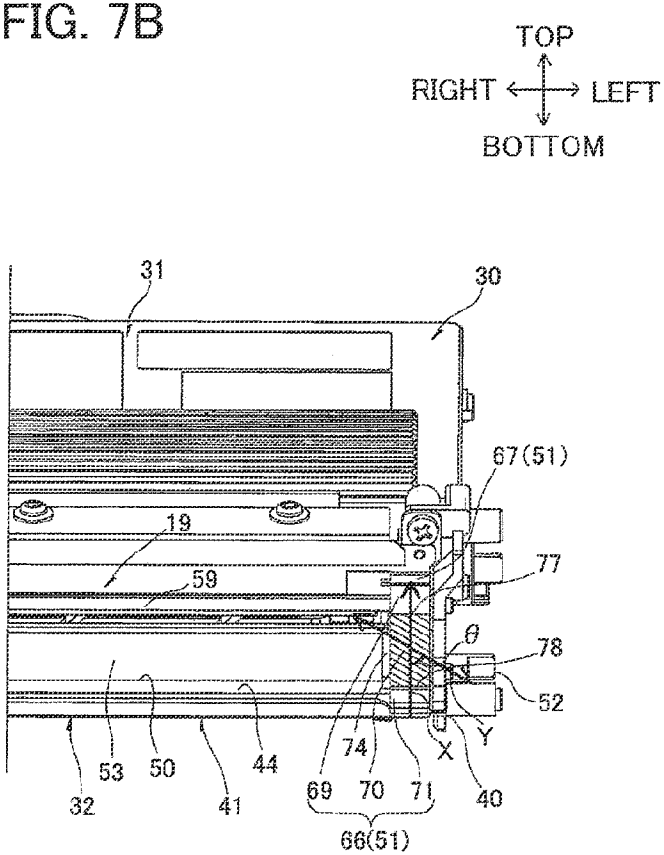
FIG. 7B is a rear side view of the leftward portion of the developing device according to the first embodiment, wherein which the contact member has been attached to the developing frame of FIG. 6.
Figure 7A:
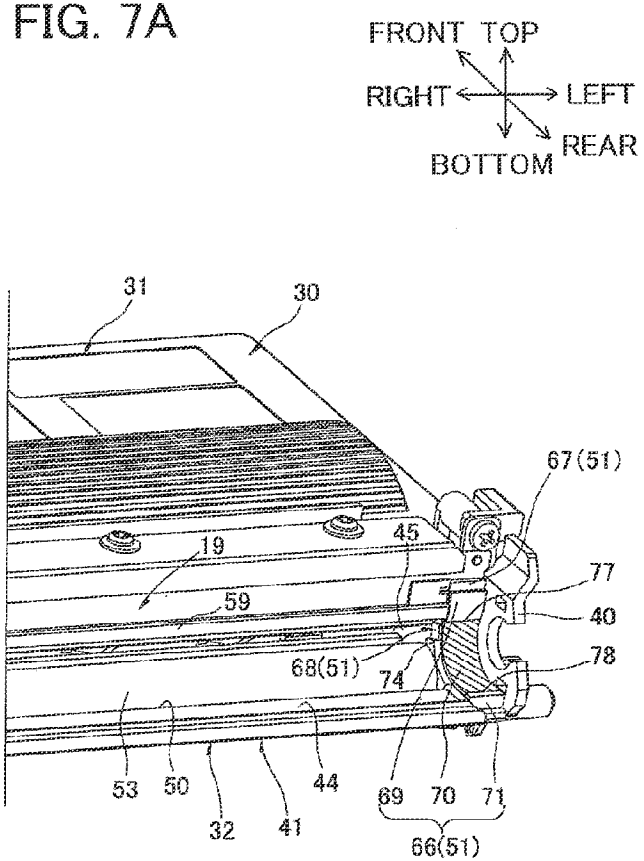
FIG. 7A is a perspective view of a leftward portion of the developing device according to the first embodiment as viewed from its rear and right side, wherein which a contact member has been attached to the developing frame of FIG. 6.

Specifically, as shown in FIG. 7B, the contact member 66 includes three seal members arranged in sequence from the downstream side to the upstream side with respect to the rotating direction X of the developing roller 16. More specifically, the contact member 66 includes a downstream seal member 69, a middle seal member 70, and an upstream seal member 71.

The downstream seal member 69 is configured to be more flexible than the middle seal member 70. Specifically, the downstream seal member 69 is configured of a felt member and is substantially rectangular in a rear view.

The middle seal member 70 is provided separately from the downstream seal member 69. The middle seal member 70 is configured of a sheet-like flocked fabric provided on a rubber base. The flocked fabric is formed by flocking fiber members formed of a resin material. More specifically, the fiber members (a bundle of fiber strands) are flockingly embedded in the base material so as to slant inward in the left-right direction from bottom to top (toward the downstream side in the rotating direction X of the developing roller 16). Accordingly, the fiber members flocked on the base material are oriented in an oblique upward and inward direction (hereinafter referred to as the "fiber slanting direction Y"). The fiber slanting direction Y is set so as to form an angle θ with the rotating direction X of the developing roller 16 of 15-75 degrees, for example, and preferably between 30 and 60 degrees.

Further, the middle seal, member 70 is configured to have a hardness level, as determined according to the method of measuring hardness described below, to be 0.14-0.24 N, for example, and preferably between 0.14 and 0.18 N.

Hardness Measuring Method

First, the middle seal member 70 is formed to be rectangular in a plan view, with a length (longitudinal dimension) of 35 mm and a width (latitudinal dimension) of 7 mm. To measure the hardness of the middle seal member 70, a 20-mm portion on one longitudinal end of the middle seal member 70 is anchored, and a force gauge manufactured by Aikoh Engineering Co., Ltd, (trade name: RX-2) is positioned to contact a free end of the middle seal member 70 from above. Next, the force gauge is used to press a right portion of the middle seal member 70 downward, and a reading of the force gauge at a point that the right side of the middle seal member 70 has been bent 90 degrees downward is set as the hardness of the middle seal member 70.

The upstream seal member 71 is formed of a material that is more flexible than the middle seal member 70 in order to restrain movement of toner particles that enter therein as the developing roller 16 rotates. Specifically, the upstream seal member 71 is configured of a nonwoven fabric. In the first embodiment, the upstream seal member 71 is a felt member. That is, the upstream seal member 71 is formed of the same material as the downstream seal member 69.

Therefore, since the downstream seal member 69 and upstream seal member 71 are configured of felt members, while the middle seal member 70 is configured of a flocked fabric, fibers in surfaces of the downstream seal member 69 and upstream seal member 71 have a stronger anisotropic structure than fibers in a surface of the middle seal member 70 (i.e., the fibers protrude in different directions toward the rubber roller 57). Accordingly, the downstream seal member 69 and upstream seal member 71 play a larger role in suppressing movement of toner particles than the middle seal member 70. On the other hand, the fibers in the surface of the middle seal member 70 are more isotropic (aligned in substantially the same direction) than the fibers in the surfaces of the downstream seal member 69 and upstream seal member 71. Accordingly, the middle seal member 70 allows toner particles to move along the direction in which its fibers are oriented.

Figure 3C:
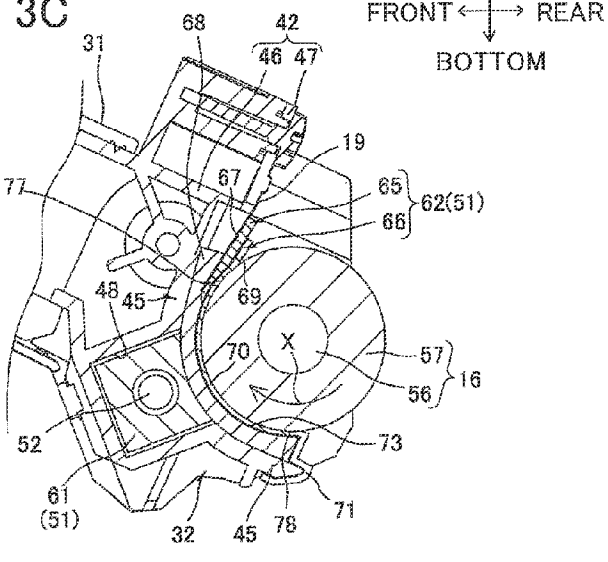
FIG. 3C is a partially-enlarged cross-sectional view of a rear portion of the developing device of FIG. 3A taken along a line B-B in FIG. 3A.

As shown in FIG. 3C, the downstream seal member 69, middle seal member 70, and upstream seal member 71 are affixed to one adhesive surface of a single strip of double-sided tape 73 on the side facing the rubber roller 57 such that an upstream edge of the downstream seal member 69 in the rotating direction X contacts a downstream edge of the middle seal member 70, and an upstream edge of the middle seal member 70 in the rotating direction X contacts a downstream edge of the upstream seal member 71. That is, the contact member 66 is integrally configured of the downstream seal member 69, middle seal member 70, and upstream seal member 71, as shown in FIG. 7A. Further, the downstream seal member 69 is disposed adjacent to the middle seal member 70 on the downstream side of the same with respect to the rotating direction X, and the upstream seal member 71 is disposed adjacent to the middle seal member 71 on the upstream side thereof. Specifically, members that will constitute the respective downstream seal member 69, middle seal member 70, and upstream seal member 71 are first fixed to the one adhesive surface of the double-sided tape 73, and the members are subsequently cut into desired shapes through a punch process or the like to form the contact member 66.

The contact member 66 also has a first seam 78 formed between the middle seal member 70 and upstream seal member 71, and a second seam 77 formed between the middle seal member 70 and downstream seal member 69.

As shown in FIG. 3C, the contact member 66 is affixed to the support member 65 using the double-sided tape 73 so that the second seam 77 is positioned between the upstream end portion of the blade-side base 67 and the peripheral surface of the rubber roller 57, and the first seam 78 is positioned between the upstream end portion of the frame-side base 68 and the peripheral surface of the rubber roller 57. In other words, the contact member 66 is supported on the support member 65, and the double-sided tape 73 is interposed between the contact member 66 and support member 65 to fix the contact member 66 to the support member 65. Hence, the middle seal members 70 are disposed near the left and right edges of the open area 50 (the inner left and right edges of the seal support parts 45), respectively.

The upstream seal member 71 has an upstream portion in the rotating direction X that covers the upstream end of the frame-side base 68. Specifically, the upstream seal member 71 runs from a top surface (rear surface) of the frame-side base 68 on the upstream end thereof, across rear end portions of the frame-side base 68 and seal support part 45, and folds around to a bottom surface of the rear portion of the seal support part 45. The upstream seal member 71 is fixed to the rear portions of the frame-side base 68 and seal support part 45 by the double-sided tape 73. Because the upstream seal member 71 is more flexible than the middle seal member 70, the upstream seal member 71 can be folded back in this way so as to conform to the rear portion of the seal support part 45. With this configuration, the upstream seal member 71 can restrict movement of the contact member 66 relative to the developing frame 30.

Figure 8:
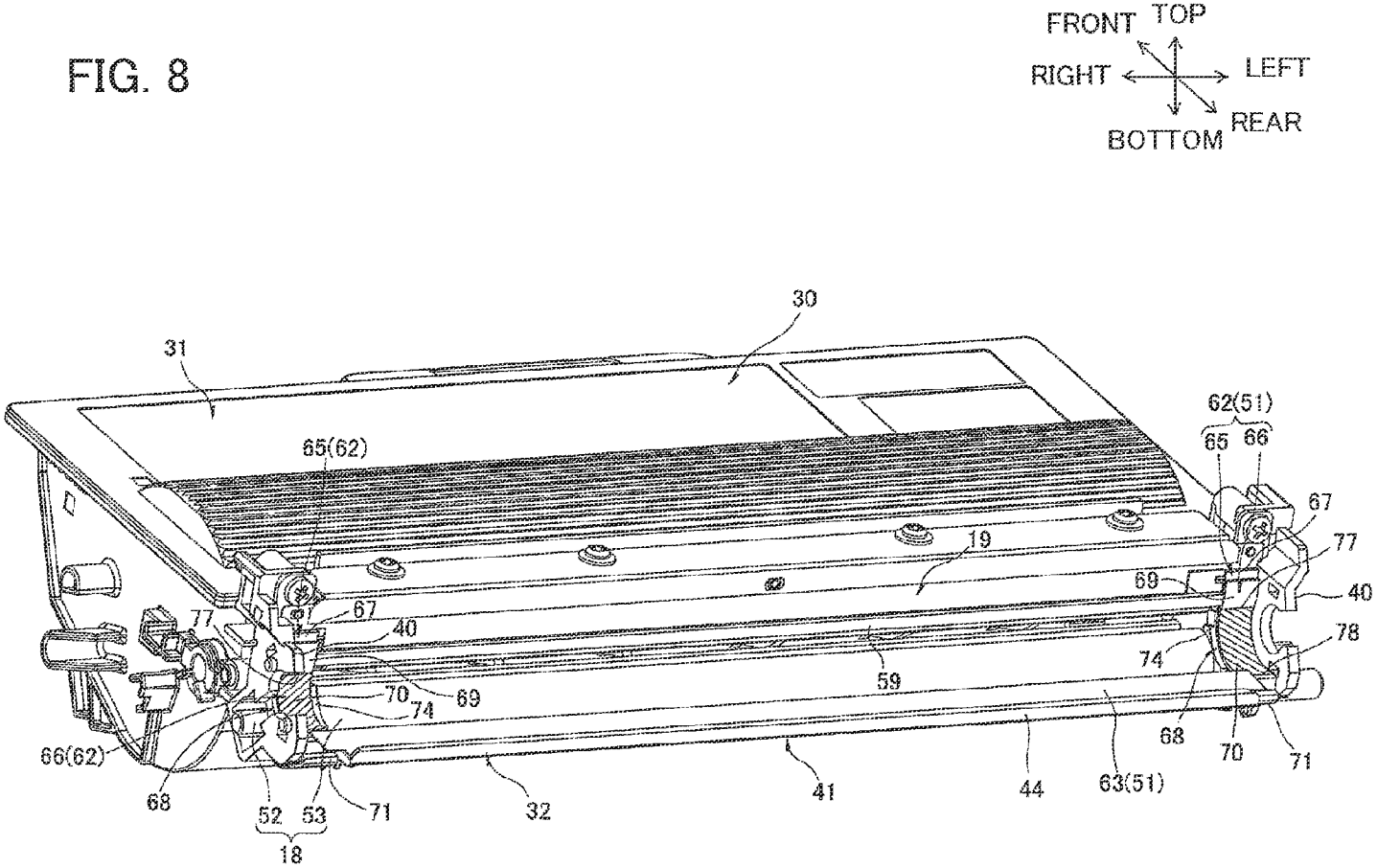
FIG. 8 is a perspective view of the developing device according to the first embodiment as viewed from its rear and right side, wherein a lower film has been assembled to the developing frame of FIGS. 7A and 7B.

The lower film 63 is formed of a resin, such as polyethylene terephthalate. As shown in FIG. 8, the lower film 63 has a sheet-like shape that is generally rectangular in a plan view and elongated in the left-right direction.

A lower sponge (not shown) is provided on a bottom surface of the lower film 63 in the area corresponding to the film-supporting wall 44. The lower sponge is configured of an elastic foam material, such as a methane sponge member, and is generally rectangular in a plan view and elongated in the left-right direction. Left and right ends of the lower sponge contact inner surfaces of the corresponding left and right frame-side bases 68.

As shown in FIG. 3B, the lower film 63 is disposed between the film-supporting wall 44 and a left-right middle portion of the peripheral surface of the rubber roller 57 between the left and right ends thereof. The lower film 63 contacts the peripheral surface on a lower portion of the rubber roller 57 and spans across the peripheral surface in the left-right direction. The left and right end portions of the lower film 63 are interposed between the corresponding middle seal members 70 and upstream seal members 71 and the peripheral surface of the rubber roller 57 on the respective left and right ends. In this way, the left and right end portions of the lower film 63 cover inner portions of the corresponding left and right first seams 78 (also see FIG. 8). The lower film 63 is fixed to the film-supporting wall 44 by bonding a lower end of the lower sponge (not shown) to the top surface of the film-supporting wall 44.

(3) Assembling the Developer Cartridge

Next, assembly of the developing cartridge 13 will be described.

To assemble the developing cartridge 13, first the supply roller 18 and the supply-roller side seals 61 are assembled in the developing chamber 32 of the developing frame 30, as shown in FIG. 4. Next the frame-side bases 68 are bonded to the corresponding seal support parts 45, as shown in FIG. 5. Next, the thickness-regulating blade 19 is fixed to the rear surface of the blade-supporting wall 47 (see FIG. 5), as shown in FIG. 6. At this time, the blade-side bases 67 are also positioned so that their bottom edges overlap the top edges of the frame-side bases 68 in the front-rear direction, as illustrated in FIG. 3B.

Then, as shown in FIG. 7A, the contact members 66 are superimposed over the corresponding frame-side bases 68 and adhesively fixed to the frame-side bases 68 with the double-sided tapes 73 so that the downstream seal members 69 are in pressure-contact with the corresponding left and right ends of the contact part 59 respectively from outward thereof in the left-right direction. Accordingly, the downstream seal members 69 are disposed adjacent to the corresponding left and right ends of the contact part 59 such that the contact part 59 is interposed between the downstream seal members 69 in the left-right direction.

At this time, as shown in FIG. 3B, the downstream seal members 69 are bonded to the corresponding rear surfaces of the blade-side bases 67 in substantially a vertical center region thereof.

The upper end of the middle seal member 70 (downstream end in the rotating direction X) is bonded to the lower end of the blade-side base 67 (upstream end) on the rear surface thereof. The middle portion of the middle seal member 70 in the vertical direction (in the rotating direction X) is bonded to the approximate vertical center region (middle region in the rotating direction X) on the rear surface of the frame-side base 68.

Further, the upper end of the upstream seal member 71 (downstream end in the rotating direction X) is bonded to the lower end of the frame-side base 68 (upstream end in the rotating direction X) on the rear surface thereof. The remaining portion of the upstream seal member 71 wraps around the rear end portion of the frame-side base 68 and the rear portion of the seal support part 45 so as to cover the rear end portion thereof. The upstream seal member 71 is thus bonded to the frame-side base 68 and seal support part 45.

Next, the lower film 63 is bonded to the top surface of the film-supporting wall 44 so that the left and right ends cover inner portions of the corresponding left and right first seams 78 from the top, as shown in FIG. 8.

The developing roller 16 is then assembled in the developing chamber 32, as shown in FIG. 2. At this time, the peripheral surface of the rubber roller 57 on the left and right ends thereof contacts the contact members 66 and the lower film 63. Specifically, this peripheral surface has a front-facing portion contacting the contact members 66, as shown in FIG. 3C. The left and right outer portions of the peripheral surface on the lower side also contact the corresponding contact members 66, while the left and right inner portions of the peripheral surface on the lower side contact the lower film 63, as shown in FIGS. 2 and 3B. The middle region of the peripheral surface of the rubber roller 57 between the left and right ends contacts the contact part 59, the sponge roller 53, and the lower film 63. Specifically, an upper front portion of this peripheral surface contacts the contact part 59, as shown in FIG. 1. A lower front portion of this peripheral surface contacts the sponge roller 53, and a bottom portion of the peripheral surface contacts the lower film 63 (see FIG. 3B).

Finally, the bearing members 54 are mounted onto the corresponding side walls 40 from the respective left and right outer sides thereof so that the left and right ends of the developing roller shaft 56 and supply roller shaft 52 (see FIG. 4) are received in the bearing members 54, as shown in FIG. 2. This completes the process of assembling the developing cartridge 13.

(4) Detailed Description of a Developing Operation

Next, a developing operation, performed with the developing cartridge 13 will be described.

In a developing operation, a drive source (not shown) provided in the main casing 2 outputs a drive force to the developing cartridge 13. The drive force is transmitted to the developing roller 16, supply roller 18, and agitator 35 in the developing cartridge 13, driving these components to rotate, as indicated in FIG. 1. As the agitator 35 rotates, the agitating blade 37 of the agitator 35 conveys toner from the toner-accommodating chamber 31 into the developing chamber 32 through the through-hole 33. Toner conveyed into the developing chamber 32 is supplied onto the sponge roller 53 of the supply roller 18. The sponge roller 53 in turn supplies the toner onto the rubber roller 57 of the developing roller 16 as the supply roller 18 rotates.

The supply-roller side seals 61 are provided on the outer sides of the left and right ends of the sponge roller 53, respectively to oppose the same in the left-right direction, as shown in FIG. 4. Hence, the supply-roller side seals 61 restrict toner from leaking out of the developing chamber 32 through the left and right ends of the supply roller 18.

As the developing roller 16 rotates, the contact part 59 of the thickness-regulating blade 19 (see FIG. 1) regulates the thickness of toner carried on the peripheral surface of the rubber roller 57. Since the contact members 66 are in contact with the peripheral surface of the rubber roller 57 on left and right ends thereof, as shown in FIG. 3A, the contact members 66 restrict toner from leaking out of the developing chamber 32 through the left and right ends of the developing roller 16 at this time.

It is a particular feature of the invention to configure the middle seal members 70 of a flocked fabric having fiber members flocked to slope upward and inward with respect to the left-right direction. Accordingly, when the developing roller 16 rotates, the fiber members of the middle seal member 70 exert a force on toner particles entering between the peripheral surface of the rubber roller 57 and the middle seal member 70 in a direction for returning the toner particles inward in the respective left or right direction.

Thus, the middle seal members 70 are specifically configured to move toner particles that enter between the rubber roller 57 and middle seal members 70 by the rotation of the developing roller 16 back inward in the respective left or right direction and to suppress toner from entering between the rubber roller 57 and middle seal members 70 from the inside with respect to the left-right direction.

3. Operations and Technical Advantages (1) In the developing cartridge 13 of the first embodiment, the middle seal members 70 disposed adjacent to the left and right edges of the open area 50 are configured to move toner particles inward in the left-right direction when the rotating developing roller 16 brings toner particles into the middle seal member 70.

Further, the upstream seal members 71 disposed adjacent to and upstream of the middle seal member 70 are made of a material that better suppresses the movement of toner particles than the middle seal member 70. Hence, even when toner particles enter the upstream seal member 71 as the developing roller 16 rotates, the upstream seal members 71 are relatively effective in suppressing movement of the particles and retaining the toner particles therein. That is, a mobility of the toner (developer) in the middle seal member 70 is higher than that in the upstream seal member 71.

This configuration can reduce the amount of toner entering the middle seal members 70 from the upstream side in the rotating direction X.

In other words, this configuration reliably ensures toner particles entering the second seal members 70 to move inward in the left-right direction (inward in the axial direction), while suppressing toner from entering the middle seal member 70 from upstream thereof in the rotating direction X. This configuration thus leads to suppression of toner leakage between the middle seal members 70 and the peripheral surface of the rubber roller 57 at the left and right ends thereof.

Therefore, toner leakage from the developing frame 30 can be suppressed even when the developing roller 16 is operated at a high speed, even when the service life of the developing cartridge 13 is extended, and even when the particle size of the toner is reduced.

(2) The middle seal members 70 are configured to exert a force on toner particles brought thereto by the rotating developing roller 16 for returning the particles inward in the left-right direction.

The toner entering the middle seal members 70 as the developing roller 16 rotates is applied with the force to move the toner inward in the left-right direction, thereby leading to reliable suppression of toner leakage.

In other words, this configuration reliably restricts toner leakage even when toner particles enter the middle seal members 70 from inward in the left-right direction and/or front upstream side thereof in the rotating direction X, since the middle seal member 70 can exert a force on the particles in a direction for returning them inward in the left-right direction.

The structures of the upstream seal member 71 and middle seal member 70 are a particular feature of the present invention. The upstream seal members 71 are formed of a material that restricts movement of toner particles that enter therein due to the rotation of the developing roller 16, while the middle seal members 70 exert a force on toner particles entering therein due to the totaling developing roller 16 for returning the toner particles inward in the left-right direction.

Accordingly, even when toner carried on the peripheral surface of the rubber roller 57 at the left and right ends thereof enters the upstream seal members 71 as the developing roller 16 rotates, the upstream seal members 71 can restrict the toner particles from migrating outward in the left-right direction. The toner reaches the middle seal members 70 while being in contact with left-right inner portions of the upstream seal members 71, and is moved inward in the left-right direction by the middle seal members 70.

Thus, this configuration can restrict toner from migrating outward in the respective leftward and rightward directions from the peripheral surface of the rubber roller 57 (outward in the axial direction of the developing roller 16).

Accordingly, if the toner still carried on the peripheral surface of the rubber roller 57 passes through the downstream seal member 69 but reaches the upstream seal member 71, this toner enters the left-right inner portion of the upstream seal member 71 on the upstream side in the rotating direction X. Subsequently, if the toner that has reached the upstream seal member 71 again passes enters the middle seal member 70 from the upstream seal member 71 as the developing roller 16 continues to rotate, the toner enters the left-right inner portion of the middle seal member 70 on the upstream side thereof.

Therefore, this configuration more effectively restrains toner leakage between the contact members 66 and the peripheral surface of the rubber roller 57.

(3) The middle seal member 70 is a flocked fabric configured of fiber members flockingly embedded on a base. As illustrated in FIG. 7B, the fiber members are flocked so as to slant in the fiber slanting direction Y, i.e., along a direction slanted inward relative to the left-right direction from the upstream side to the downstream side in the rotating direction X.

Accordingly, the middle seal members 70 can reliably exert a force on the particles entering the middle seal members 70 by the rotating developing roller 16 in a direction for returning the particles inward in the left-right direction.

(4) The upstream seal member 71 is configured of a nonwoven fabric, i.e., a sheet-like fabric formed of intertwined fiber members. Accordingly, toner entering the upstream seal members 71 is trapped in the intertwined fiber members of the fabric and retained therein.

More particularly, since the fiber members of the upstream seal member 71 are intertwined, the fiber members are more anisotropic (protruding in dissimilar directions toward the rubber roller 57) than those of the middle seal member 70. As a result, the upstream seal members 71 can reliably retain toner particles that enter therein. This configuration can further serve to reduce the amount of toner entering the middle seal members 70 from the upstream side in the rotating direction X.

(5) The upstream seal member 71 is configured of a felt member. Hence, the upstream seal members 71 can be brought into close contact with the peripheral surface of the rubber roller 57.

Thus, this configuration can restrict gaps from being formed between the upstream seal members 71 (upstream parts of the contact members 66 in the rotating direction X) and the peripheral surface of the rubber roller 57, and reliably scrapes the toner off the peripheral surface of the rubber roller 57.

Consequently, the amount of toner entering the middle seal members 70 from upstream side thereof in the rotating direction X can be further reduced.

(6) As shown in FIG. 8, the developing cartridge 13 is provided with the lower film 63. The lower film 63 is disposed between the film-supporting wall 44 and the peripheral surface of the left-right middle portion of the rubber roller 57 and contacts the peripheral, surface along the left-right direction. With this configuration, the lower film 63 can restrict toner leakage between the film-supporting wall 44 and the peripheral surface of the rubber roller 57.

Further, the lower film 63 is arranged such that its left and right end portions are interposed between the corresponding contact members 66 and the peripheral surface of the rubber roller 57 at the left and right ends thereof to cover the respective left and right inner portions of the first seam 78 front above (from the developing roller 16 side). Accordingly, the left and right end portions of the lower film 63 contact the peripheral surface of the rubber roller 57 at the left and right ends thereof.

With this construction, the left and right end portions of the lower film 63 can scrape toner off the peripheral surface of the rubber roller 57 at the left and right ends thereof. Accordingly, the lower film 63 not only restricts toner leakage between the film-supporting wall 44 and the peripheral surface of the rubber roller 57 in the left-right middle portion thereof, but also further restricts toner leakage between the contact members 66 and the peripheral surface of the rubber roller 57 at the left and right ends thereof.

Particularly, the first seam 78 is formed by the middle seal member 70 and the upstream seal member 71 having greater flexibility than the middle seal member 70. In this way, an edge (step) is formed at the first seam 78 when contacted by the peripheral surface of the rubber roller 57 due to the difference in flexibility between the middle seal member 70 and upstream seal member 71.

This means that an edge (step) is produced in each of the left and right end portions of the lower film 63 disposed over the first seam 78. The edges formed in the left and right end portions of the lower film 63 function to stem the flow of toner onto the lower film 63 as the developing roller 16 rotates. Hence, this configuration more effectively restricts toner leakage between the left and right end portions of the lower film 63 and the peripheral surface of the rubber roller 57 at the left and right ends thereof.

(7) The contact member 66 includes the downstream seal member 69. Hence, this structure can restrict toner leakage between the downstream seal member 69 (downstream parts of the contact members 66 in the rotating direction X) and the peripheral surface of the rubber roller 57.

Therefore, this configuration more effectively restricts toner leakage between the contact members 66 and the peripheral surface of the rubber roller 57 at the left and right ends thereof.

(8) As shown in FIG. 6, the developing cartridge 13 is provided with the thickness-regulating blade 19. With the contact part 59 of the thickness-regulating blade 19 contacting (sliding against) the peripheral surface of the rubber roller 57 constituting the developing roller 16, the thickness-regulating blade 19 can regulate the thickness of the toner layer carried on the rubber roller 57 when the developing roller 16 rotates (see FIG. 1).

As shown in FIG. 7A, the two downstream seal members 69 are disposed adjacent to and outward of the left and right ends of the contact part 59 in the left-right direction (ends of the contact part 59 with respect to the axial direction of the developing roller 16) respectively so as to contact the left and right ends of contact part 59 with pressure, the pressure being applied inward from the outside of the left and right ends.

This configuration prevents gaps from being formed at the borders between the contact part 59 and downstream seal members 69, thereby suppressing toner leakage through such gaps. Accordingly, the thickness-regulating blade 19 can be configured to regulate the thickness of toner carried on the rubber roller 57, while preventing toner from leaking at the borders between the contact part 59 and downstream seal members 69.

(9) The downstream seal members 69 have greater flexibility than the middle seal members 70. Hence, the downstream seal members 69 can closely contact both the peripheral surface of the rubber roller 57 and the left and right ends of the contact part 59 of the thickness-regulating blade 19.

This configuration restricts formation of gaps between the downstream seal member 69 (downstream parts of the contact members 66 in the rotating direction X) and the peripheral surface of the rubber roller 57, and can reliably prevent gaps from being formed between the contact part 59 and the downstream seal members 69.

Accordingly this structure of the first embodiment can suppress toner leakage between the downstream seal members 69 and the peripheral surface of the rubber roller 57, and can further suppress toner leakage at the borders between the contact part 59 and downstream seal members 69.

(10) Since the upstream seal members 71 are formed of the same material as the downstream seal members 69, material costs for manufacturing the upstream seal members 71 and downstream seal members 69 is less than when the members are formed of dissimilar materials.

Second and Third Embodiment

Next, a downstream seal member 269 according to a second embodiment of the present invention and a downstream seal member 369 according to a third embodiment of the present invention will be described with reference to FIGS. 9A and 9B respectively.

In the followings, like parts and components identical to those of the first embodiment are designated with the same reference numerals as those of the first embodiment to avoid duplicating description.

In the first embodiment described above, the second seams 77 are formed to extend in the left-right direction, as illustrated in FIG. 7B. However, in the second and third embodiments, second seams 277, 377 has respective left-right inner portions that are positioned downstream in the rotating direction X relative to left-right outer portions of the second seams 277, 377.

With this construction, toner that enters contact member 266, 366 and that arrives at the second seam 277, 377 is moved, as the developing roller 16 rotates, toward downstream in the rotating direction X, i.e., inward in the left-right direction. Accordingly, these constructions can restrict toner particles from leaking through the second scams 277, 377.

(1) Second Embodiment

Figure 9B:
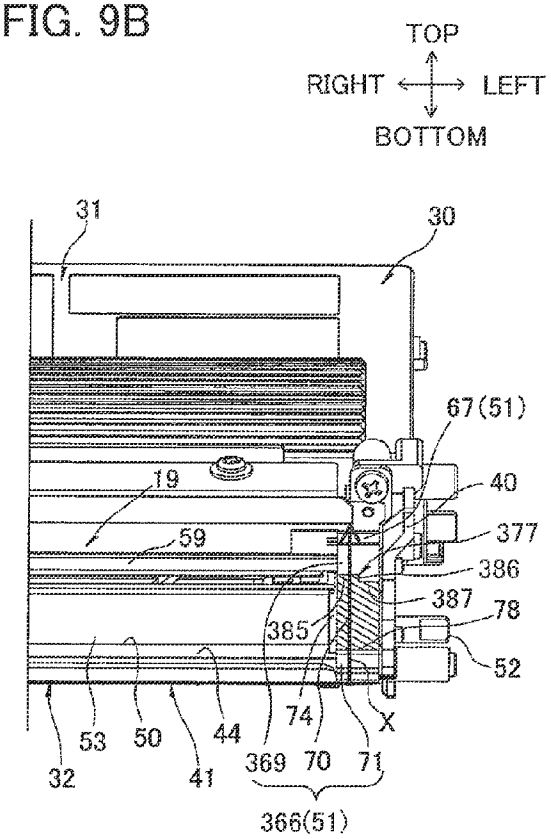
FIG. 9B is a rear side view of a leftward portion of a developing device according to a third embodiment of the present invention, wherein the developing roller has been removed.
Figure 9A:
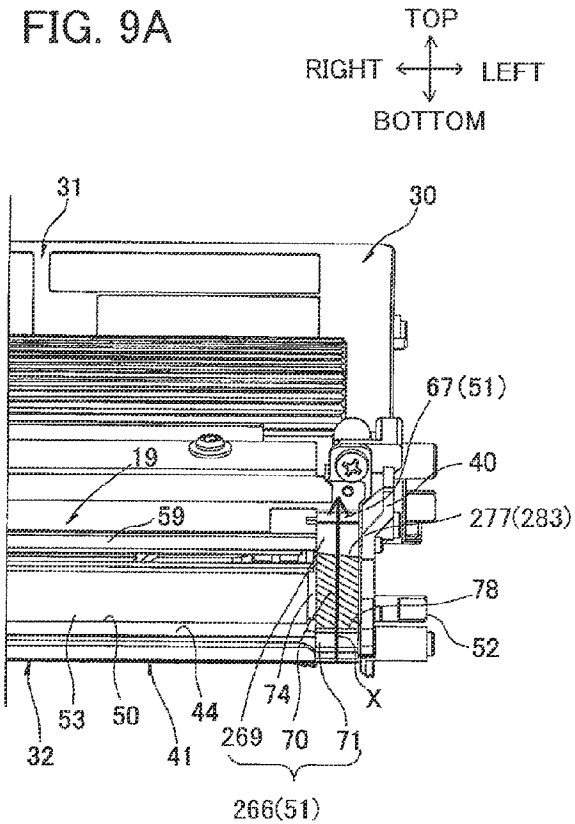
FIG. 9A is a rear side view of a leftward portion of a developing device according to a second embodiment of the present invention, wherein the developing roller has been removed.

Specifically, as shown in FIG. 9A, the second seams 277 of the second embodiment shown are slanted downstream in the rotating direction X from outside to inside in the left-right direction. Although the entire second seam 277 is slanted in the second embodiment described above, it is possible to form a portion of the second seam 277 as a slanted part 283, where only the slanted part 283 is slanted downstream in the rotating direction X from outside to inside.

Since the entire second seam 277 constitutes the slanted part 283 in the second embodiment, toner entering the contact member 266 and arriving at the second seam 277 is guided inward in the respective left or right direction (inward in the axial direction of the developing roller 16) along tire slanted part 283 as the developing roller 16 rotates. Therefore, this configuration can reliably restrict toner from leaking through the second seam 277 (slanted part 283).

With this construction of the second embodiment, the same operations and technical advantages as those of the first embodiment can be achieved.

(2) Third Embodiment

In the third embodiment shown in FIG. 9B, the second seams 377 follow a zigzag shape in a rear view. Specifically, each second seam 377 includes a first orthogonal part 385, a linear part 386, and a second orthogonal part 387.

The first orthogonal part 385 extends outward in the respective left or right direction from a left-right inner edge of the corresponding contact member 66.

The linear part 386 is bent approximately 90 degrees from an outer end of the first orthogonal part 385 and extends downward. In other words, the linear part 386 is aligned with the rotating direction X and extends upstream in the rotating direction X from the first orthogonal part 385.

The second orthogonal part 387 is bent approximately 90 degrees from a bottom end of the linear part 386 (upstream end in the rotating direction X) and extends outward in the respective left or right direction.

Incidentally, the downstream seal member 369 may be subject to move (shift) downstream in the rotating direction X due to its sliding contact with the peripheral surface of the rubber roller 57. Thus, the second seam 377 (border between the downstream seal member 369 and the middle seal member 70) may be caused to widen in the rotating direction X to form a gap between the downstream seal member 369 and the middle seal member 70, possibly resulting in toner leakage through the gap.

However, due to the provision of the linear part 386 aligned in the rotating direction X, the second seam 377 having this configuration restricts formation of a gap at the linear part 386, even if the downstream seal member 369 were to shift downstream in the rotating direction X. Further, the linear part 386 is formed to extend upstream in the rotating direction X from the first orthogonal part 385. Hence, if toner enters the first orthogonal part 385 laterally inward thereof in the left-right direction and migrates to the linear part 386, for example, the toner is suppressed from moving upstream in the rotating direction X along the linear part 386 as the developing roller 16 rotates. Therefore, the second seam 377 according to the third embodiment can reliably restrict toner from leaking therethrough.

With this construction of the third embodiment, the same operations and technical advantages as those of the first embodiment can be achieved.

Variations and Modifications

In the first embodiment, the middle seal member 70 shown in FIG. 7B is configured of a flocked fabric. However, the middle seal member 70 may be configured of a fabric woven of cashmere fibers, for example. In this case, the fabric configuring the middle seal member 70 is preferably woven so that the strands protruding toward the rubber roller 57 slant inward with respect to the left-right direction from the upstream side toward the downstream side in the rotating direction X. With this configuration, the middle seal member 70 can exert force on toner particles entering therein in a direction for returning the particles inward in the respective left or right direction.

With this construction, the same operations and technical advantages as those of the first embodiment can be achieved.

Alternatively, the middle seal member 70 may be configured of an elastic member. In this case, the elastic member constituting the middle seal member 70 preferably has grooves formed in the surface on the rubber roller 57 side that slope inward in the left-right direction from the upstream side to the downstream side in the rotating direction X. This configuration exerts force on toner particles entering the middle seal member 70 in a direction for returning the particles inward in the respective left or right direction.

With this construction, the same operations and technical advantages as those of the first embodiment can be achieved.

Further, in the first embodiment, the upstream seal member 71 is configured of a nonwoven fabric, and specifically a felt member. However, the upstream seal member 71 may the configured of an elastic member (for example, an elastic foam member such as a urethane sponge member, or a rubber member such as a methane rubber member).

With this construction, the same operations and technical advantages as those of the first embodiment can be achieved.

Further, instead of the developing roller 16 in the first through third embodiments, a developing sleeve may be employed.

It should be noted that constructions described with respect to the first to third embodiments and modifications can be appropriately combined.

While the invention has been described in detail with reference to the embodiments thereof, it would be apparent to those skilled in the art that various changes and modifications may the made therein without departing from the spirit of the invention.

What is claimed is:

1. A developing device comprising:

a frame formed with an opening and having an internal space for accommodating developer therein;

a developer carrying member rotatably supported to the frame and disposed to oppose the internal space via the opening, the developer carrying member defining an axis extending in an axial direction and configured to rotate about the axis in a rotating direction, the developer carrying member having an axial end portion and a remaining portion inward of the axial end portion in the axial direction; and a side seal disposed between the frame and a peripheral surface of the axial end portion of the developer carrying member, the side seal having a contact member configured to be in contact with the peripheral surface, the contact member comprising:

a first seal member disposed adjacent to an edge of the opening in the axial direction and configured to permit the developer entering the first seal member by rotation of the developer carrying member to move inward in the axial direction; and a second seal member disposed adjacent to and upstream of the first seal member in the rotational direction, the second seal member being a separate member from the first seal member and being made of a material that restricts movement of the developer entering therein by the rotation of the developing carrying member, the first seal member providing a mobility of the developer therein higher than that in the second seal member, wherein the second seal member comprises a nonwoven fabric.

2. The developing device as claimed in claim 1, wherein the first seal member is configured to exert a force on the developer entering therein by the rotation of the developer carrying member to move the developer inward in the axial direction.

3. The developing device as claimed in claim 2, wherein the first seal member comprises a flocked fabric including a base member and fiber members flockingly embedded in the base member such that the fiber members are oriented inward with respect to the axial direction toward downstream in the rotating direction.

4. The developing device as claimed in claim 1, wherein the second seal member is a felt member.

5. The developing device as claimed in claim 1, further comprising a film member extending in the axial direction and disposed between the frame and a peripheral surface of the remaining portion of the developer carrying member and configured to contact the peripheral surface of the remaining portion, wherein the first seal member and the second seal member provide a first seam therebetween, and wherein the film member has an axial end portion disposed between the contact member and the axial end portion of the developer carrying member and covering a portion of the seam.

6. The developing device as claimed in claim 1, wherein the contact member further comprises a third seal member disposed adjacent to and downstream of the first seal member in the rotating direction.

7. The developing device as claimed in claim 6, further comprising a thickness regulating blade having a contact part extending in the axial direction and configured to contact a peripheral surface of the remaining portion of the developer carrying member in the axial direction, and wherein the third seal member is disposed adjacent to and outward of the contact part in the axial direction and in pressure contact with the contact part.

8. The developing device as claimed in claim 7, wherein the third seal member has a flexibility higher than a flexibility of the first seal member.

9. The developing device as claimed in claim 7, wherein the third seal member is made of a material the same as a material of the second seal member.

10. The developing device as claimed in claim 6, wherein in the contact member the first seal member and the third seal member provide a seam therebetween, the seam having an inner portion and an outer portion in the axial direction, the inner portion being positioned more downstream than the outer portion in the rotating direction.

11. The developing device as claimed in claim 10, wherein the seam has a slanted part sloping inward in the axial direction toward downstream in the rotating direction.

12. The developing device as claimed in claim 10, wherein the seam has a linear part extending in the rotating direction.

* * * * *